United States Patent [19]

Okada

[11] Patent Number: 4,822,318

[45] Date of Patent: Apr. 18, 1989

[54] COIN DISPENSER

[75] Inventor: Kazuo Okada, Tokyo, Japan

[73] Assignee: Kabushiki Kaisha Universal, Tochigi, Japan

[21] Appl. No.: 931,868

[22] Filed: Nov. 18, 1986

[30] Foreign Application Priority Data

Nov. 18, 1985 [JP] Japan ..... 60-256759

[51] Int. Cl.[4] ..... G07D 1/00

[52] U.S. Cl. ..... 453/57; 453/32; 453/58; 221/203

[58] Field of Search ..... 453/57, 58, 30, 31, 453/32, 6, 10, 12; 221/203, 277; 108/20, 103, 139

[56] References Cited

U.S. PATENT DOCUMENTS

| | | | |
|---|---|---|---|
| 1,699,463 | 1/1929 | Cresci | 108/20 |
| 2,990,975 | 7/1961 | Sereno | 221/203 |
| 3,829,722 | 8/1974 | Rosenthal, Jr. et al. | 310/62 X |
| 4,086,928 | 5/1978 | Ristvedt et al. | 453/6 |
| 4,441,515 | 4/1984 | Goepner | 221/203 X |
| 4,615,350 | 10/1986 | Boudville | 453/57 |

FOREIGN PATENT DOCUMENTS

| | | | |
|---|---|---|---|
| 0157405 | 10/1985 | European Pat. Off. . | |
| 2359466 | 2/1978 | France | 453/57 |
| 2105508A | 3/1983 | United Kingdom . | |

*Primary Examiner*—Kevin P. Shaver
*Assistant Examiner*—Stephen B. Parker
*Attorney, Agent, or Firm*—Young & Thompson

[57] ABSTRACT

A coin dispenser for discharging coins stored in a bucket in an automatic vending machine, a money exchanging machine, a coin-operated amusement machine such as a slot machine and the like, comprising a bucket for storing a number of coins therein which has an opening at its bottom, a rotary disk driven by a motor for receiving thereon coins supplied from the bucket through the opening, the rotary disk being adapted to rotate in a substantially horizontal plane and causing the coins placed thereon to slide outwardly with centrifugal force; and a guide wall adapted to guide the coins impelled by centrifugal force along the periphery of the rotary disk and formed with an opening for discharging the coins. The rotary disk comprises a rotary pedestal including a hub fixed to an output shaft of a motor and a plurality of frames projecting in the radial direction from the hub, and a thin disk fixed to the rotary pedestal and adapted to bear the coins thereon. In this way, the rotary disk as a whole can be made light in weight, and can greatly reduce the load on the motor when the rotary disk is suddenly stopped upon having finished paying out coins.

5 Claims, 4 Drawing Sheets

COIN DISPENSER

BACKGROUND OF THE INVENTION

The present invention relates to an improvement in coin dispensers which are adapted to discharge coins at a high rate.

As is well known in the art, automatic vending machines, money exchanging machines, coin- or token-operated amusement machines such as slot machines, etc. have a coin or token (hereinafter referred to as coins) dispenser therein which is adapted to discharge coins into a pay-out outlet.

Such a coin dispenser usually includes a motor-driven rotary disk placed beneath a bucket which stores therein a number of coins to be discharged, the rotary disk being rotated having a substantially horizontal rotary plane. This coin dispenser is so designed that coins are supplied from an opening at a lower portion of the bucket at a high rate due to centrifugal force caused by rotation of the rotary disk. Between the opening at the lower portion of the bucket and the rotary disk, there is provided a regulating plate which is adapted to rotate independently of the rotary disk, so that the weight of coins stored within the bucket will not be directly imposed on the rotary disk. Due to the foregoing arrangement, rotation of the rotary disk is further facilitated, thereby greatly to improve the coin pay-out performance.

The above-mentioned conventional coin dispenser using a rotary disk is required to stop suddenly the driving of the rotary disk at the time when a coin pay-out stop signal is issued. However, since the rotary disk which is employed in the conventional coin dispenser is large in inertial mass, even if the drive motor is electrically stopped by issuance of the coin pay-out stop signal, the inertia of the rotary disk is imposed on the motor as a heavy load. Such a load tends to overheat the motor, which greatly shortens the service life of the motor.

SUMMARY OF THE INVENTION

The present invention was conceived in order to solve the above-mentioned shortcoming of the conventional art.

It is, therefore, the principal object of the present invention to provide a coin dispenser in which a coin discharging rotary disk, which is rotated at a high speed by a motor, is made light in weight, so that it can be suddenly stopped without imposing a large load on the motor.

In order to achieve the above-described object, the present invention includes a coin discharging rotary disk, which is driven by a motor, comprising a rotary pedestal having a rigid frame structure of light weight and a disk formed of a thin plate of light weight. Thus, the rotary disk as a whole is made light in weight. The rotary pedestal comprises a hub directly connected with a driven shaft of the motor and a plurality of reinforcing frames projecting in the radial direction from the hub. By supporting the rotary disk through these frames, distortion of the rotary disk is avoided and its rigidity is maintained.

In preferred embodiments of the present invention which will be described hereinafter, the aforementioned plurality of frames are integrally formed with a fin. Due to the foregoing arrangement, when the rotary disk is driven, air is directed to the motor by the fin.

BRIEF DESCRIPTION OF THE DRAWINGS

The above and other objects and features of the present invention will become apparent to those skilled in the art upon reading the following detailed description with reference to the accompanying drawings in which.

DETAILED DESCRIPTION OF THE INVENTION

A preferred embodiment of the present invention will be described with reference to the accompanying drawings.

Figure 4:
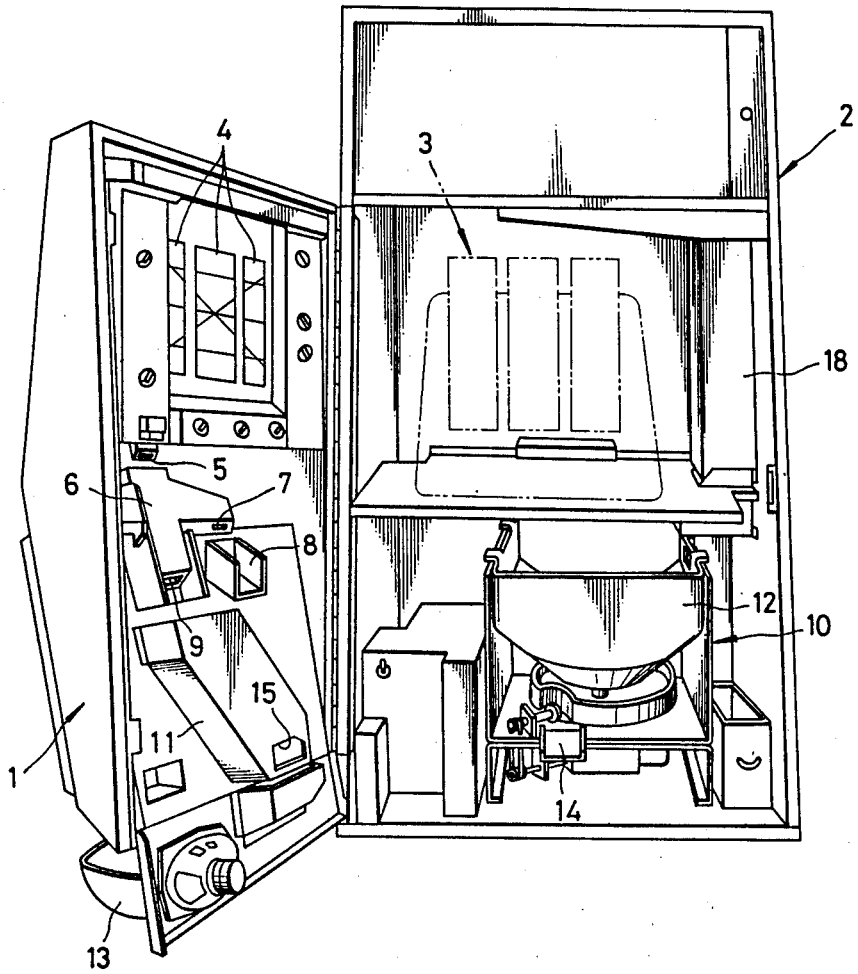
FIG. 4 is a perspective view showing a slot machine in which the present invention is incorporated.

In FIG. 4 which illustrates a slot machine with its front door 1 open, a housing 2, which is closed by the front door 1, is provided with a set of reel assemblies 3 well known per se each of which includes a rotatable reel having an annular row of various symbols arranged thereon at regular intervals. The front door 1, which is usually closed when a game is played, is adapted to allow symbols on each reel to be observed through reel windows 4 provided therein.

A coin selector 6 is provided to receive coins inserted prior to the start of a game into a coin slot (not shown), through an exit 5 communicating with the coin slot and to then distinguish genuine coins from counterfeits therein. The coin selector 6 transfers the genuine coins into a main bucket 12 of a coin dispenser 10 through its outlet 7 and a chute 8 and the counterfeits to a coin receptacle 13 from a pay-out outlet through another outlet 9 and a chute 11.

As a result of a win decision, if in fact there is a win, the coin dispenser 10 is actuated to pay out as many coins as correspond to that win, into the coin receptacle 13 from a pay-out outlet 15 formed in the chute 11, through a dispenser chute 14.

Figure 1:
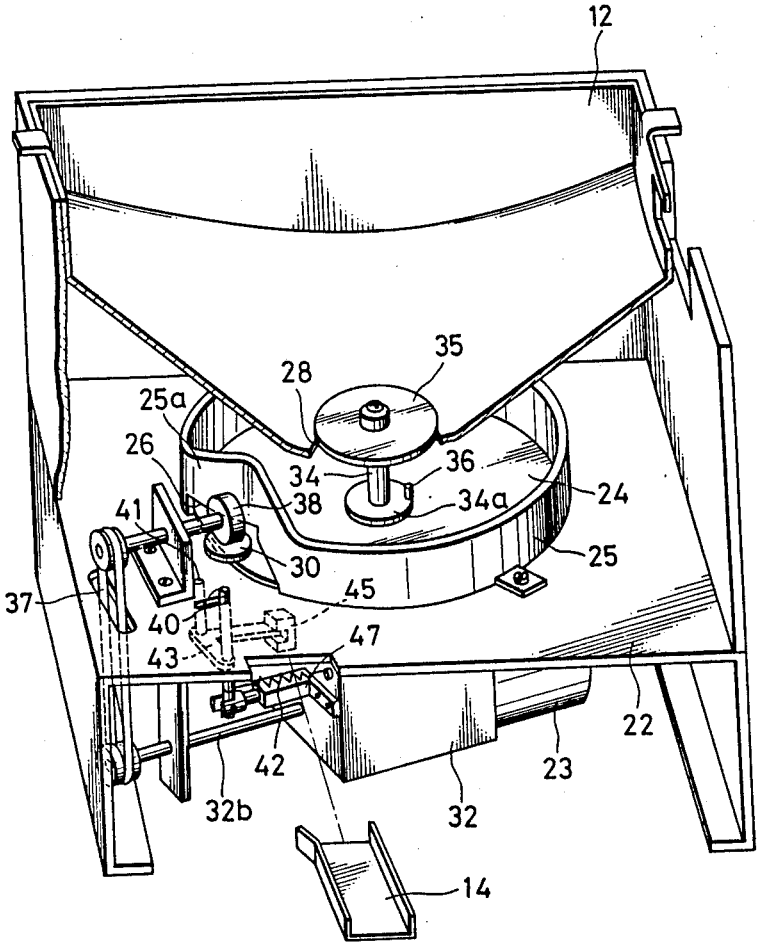
FIG. 1 is a perspective view showing an embodiment of the present invention.
Figure 2:
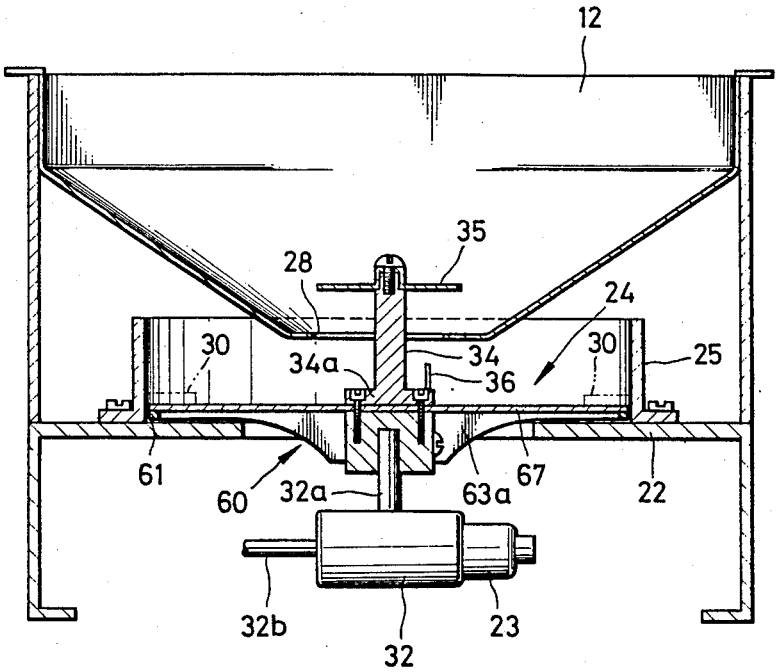
FIG. 2 is a sectional view of the embodiment of FIG. 1.
Figure 3:
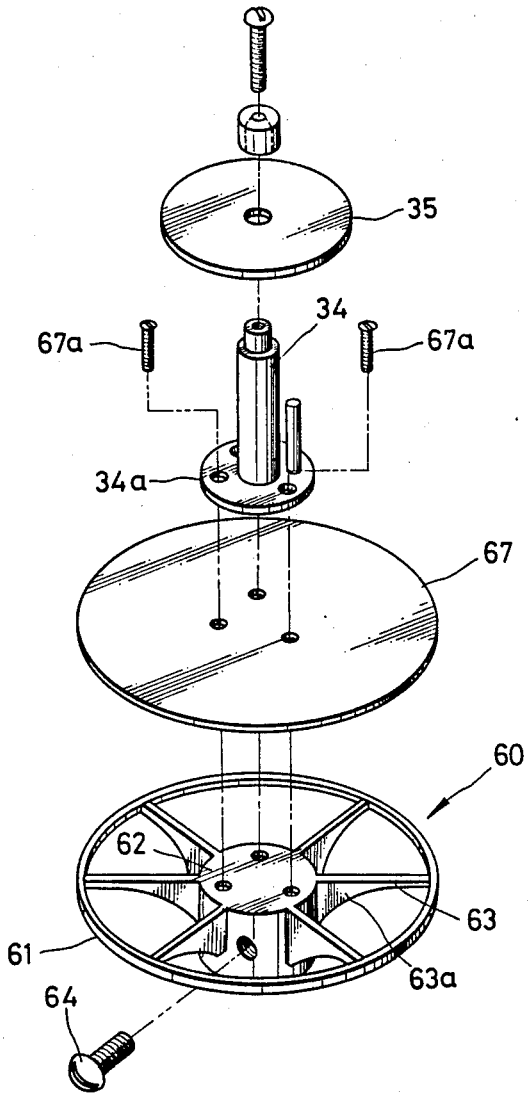
FIG. 3 is an exploded perspective view showing an important portion of the embodiment of FIG. 1.

In FIGS. 1, 2 and 3 which illustrate one embodiment of the aforementioned coin dispenser 10, a base plate 22 generally horizontally attached to the housing 2 of the slot machine is provided with a rotary disk 24 which is driven by a motor 23. On the base plate 22, there is provided a substantially cylindrical guide wall 25 in such a way as to surround the rotary disk 24. As is apparent from FIG. 1, the guide wall 25 has a part **25*a* which is depressed inwardly and is formed with an exit slot 26 at its bottom edge. This exit slot 26 is so formed as to allow a coin 30** disposed horizontally to pass therethrough.

Above the base plate 22, there is provided the funnel-shaped bucket 12 having an opening 28 at its bottom. Coins stored in the bucket 12 can fall down through the opening 28 onto the rotary disk 24. As is seen in FIG. 2, the bucket 12 is formed with a collar at its bottom so as to render coins falling down as horizontal as possible. This collar serves to promote a smooth flow of coins from the bucket 12 onto the rotary disk 24.

As is shown in FIGS. 2 and 3, the rotary disk 24 comprises a rotary pedestal 60 made of a lightweight metallic material and a lightweight and thin disk 67 made of a synthetic resin, etc. The rotary pedestal 60 comprises a circular rim 61, a circular hub 62 and a plurality of ribs 63 extending in the radial direction from the hub 62 and adapted to integrate the rim 61 and the hub 62. At the inner ends of the ribs 63 are integrally formed triangular fins 63*a* whose lower edges are inclined upwardly outwardly.

The rotary pedestal 60 is fixedly secured to an output shaft 32*a* of a gearbox 32 which is connected to the motor 23, by a screw 64. Between the hub 62 of the rotary pedestal 60 and a flange 34*a* of a mounting shaft 34, a disk plate 67 is tightly secured by screws 67*a*. Disk 24 is thus sufficiently strong to resist deformation, despite the weight of coins on the thin disk 67. In addition, the total weight of the rotary disk 24 as a whole can be greatly reduced. Furthermore, since the fins 63*a* formed on the ribs 63 direct air to the motor 23 when the rotary disk 24 is being rotated, the motor 23 will thus be cooled. The fins 63*a* can be easily formed, if the rotary disk 24 is constructed in such a way as to separate it into two parts, e.g., rotary pedestal 60 and disk plate 67.

The mounting shaft 34, which passes through opening 28 and extends inside the bucket 12, is provided with a control disk 35 freely rotatably mounted at its top. Thus, the disk 35 is free to rotate relative to the rotary disk 24 which is rotated by the motor 23 connected to the gearbox 32 through the output shaft 32*a*. The shaft 34 has a flange 34*a* at its lower end which is provided with a pin 36 projecting therefrom. This pin 36 is rotated together with the rotary disk 24 so as to avoid congestion of the coins in opening 28 and to ensure that the coins can reach the outer periphery of disk 67.

Adjacent the exit slot 26 there is a resilient roller 38 made of, for example, rubber which is connected to the output shaft 32*b* of the gearbox 32 through a belt 37 for rotation in order to discharge coins passing the exit slot 26 toward the chute 14.

Between the elastic roller 38 and the chute 14 there is a coin sensing means which comprises a sensing pin 40 positioned in the path of coins discharged by the roller 38. The sensing pin 40 is provided on an arm 43 which is forced by a spring 42 to turn in the counterclockwise direction about fulcrum 41, as seen in FIG. 1. A coin discharged by the roller 38 strikes the sensing pin 40, turning the arm 43 in the clockwise direction as seen in FIG. 1 against the force of the spring 43, and then reaches the chute 14. The turning of the arm 43 when a coin strikes the sensing pin 40 is detected by a photosensor 45, whereby the coins discharged by the roller 38 can be counted. As is shown in FIG. 1, the sensing pin 40 at its lower end is connected to an arm of a solenoid 47 which pulls the sensing pin 40 when energized and holds it so as to disable the arm 43 from turning on.

The operation of the coin dispenser 10 will be described hereunder.

As a result of a win decision based on the combinations of symbols displayed in the windows 4, if in fact there is a win, the motor 23 is started to rotate the rotary disk 24 and the resilient roller 38 in the counterclockwise direction as seen in FIG. 1. The rotation of the rotary disk 24 causes coins 30 supplied thereonto through the opening 28 of the bucket 12 to slide outwardly under centrifugal force. When the edge of the coin 30 contacts the guide wall 25, then the coin 30 is moved along the inner surface of the guide wall 25.

The coin 30, when it reaches the depressed part 25*a* of the guide wall 25, is discharged outside the guide wall 25 by passing through the exit slot 26. At this time, the discharged coin 30 is held between the rotating resilient roller 38 and rotary disk 24, and is forced by the resilient roller 38 to fly out toward the chute 14 and is then paid out into the coin receptacle 13 passing through the chute 11 and the pay-out outlet 15.

Between the roller 38 and the chute 14, the discharged coin strikes the sensing pin 40 so as to turn the arm 43 in the clockwise direction as seen in FIG. 1 against the spring 42. This turning of the arm 43 is detected by the photosensor 45. During the rotation of the rotary disk 24, coins are discharged one by one in the manner described above, and the movement of the arm 43 is detected every time a coin is discharged. Since the photosensor 45 is adapted to produce one pulse signal for every detection of the arm 43, the number of coins discharged into the coin receptacle 13 can be known by counting the pulse signals by a well known means such as a counter. When a predetermined number of coins corresponding to a combination of the symbols of a win are paid out, the motor 23 is stopped, and the coin pay-out operation is completed.

In the above-described coin dispenser 10, the rotary control disk 35 is rotatably mounted on and relative to the shaft 34 projecting from the rotary disk 24. This control disk 35 can bear the greater part of the load of a large number of coins in the basket 12 and thereby prevent the rotary disk 24 from being subjected to a heavy load. Moreover, since the control disk 35 is rotatable independently from the shaft 34, it can allow the rotary disk 24 to rotate without reducing its speed of rotation even if the control disk 35 is buried under a large number of coins.

Even if the bucket 12 is filled to capacity with coins, the coins advancing under the control disk 35 are not subject to large forces. Consequently, it is possible to stir the coins by the pin 36 projecting from the flange 34*a* on the shaft 34 so as to distribute the weight thereof on the rotary disk 24. As a result of stirring the coins, coins are prevented from getting stuck between the control disk 35 and the bucket 12 around the opening 28.

In the above-described coin dispenser 10, it is possible to achieve a coin discharge rate of at least 15 or 16 coins per second. In addition, the rotary disk 24 is of lightweight construction. Thus, when the motor 23 is stopped, the disk 24 can be instantly stopped without imposing a large load on the motor 23.

As described in the foregoing, a coin dispenser according to the present invention includes a coin discharging rotary disk, which is driven by a motor, comprising a rotary pedestal having a rigid frame structure of light weight and a disk plate formed of a thin plate of light weight. Thus, the rotary disk as a whole can be made light in weight, and can greatly reduce the load on the motor when the rotary disk is suddenly stopped rotating at the end of paying out coins. In addition, the disk, which is adapted to rotate carrying coins thereon, can be kept free from distortion and its rigidity can be maintained despite the fact that the disk is thin in order to make the coin discharging rotary disk light in weight as a whole. Thus, a stable coin pay-out operation can be achieved.

The invention has been described with particular reference to a preferred illustrative embodiment thereof, but it will be understood that variations and modifications can be effected within the spirit and scope of the invention.

What is claimed is:

1. A coin dispenser comprising:

a bucket for storing a number of coins therein which has an opening at its bottom;

a rotary disk driven by a motor for receiving thereon coins supplied from said bucket through said opening, said rotary disk being adapted to rotate in a substantially horizontal plane and causing said coins placed thereon to slide outwardly under centrifugal force; and a guide wall adapted to guide the coins along the periphery of said rotary disk and formed with an opening for discharging the coins;

said rotary disk comprising: a rotary pedestal including a hub fixed to an output shaft of said motor and a plurality of ribs projecting in the radial direction from said hub, said hub comprising a peripheral array of axially extending bores; a thin disk fixed to said rotary pedestal and supported by said ribs and adapted to bear the coins thereon, said thin disk comprising a plurality of holes aligned with said bores of said hub; a control shaft having a radially outwardly extending flange formed on one end thereof, said flange comprising a plurality of holes aligned with said bores of said hub; and a screw passing through each said hole of said flange and said thin disk, each said screw having a shank fixed in a said bore of said hub and a head bearing on said flange of said control shaft, said control shaft comprising a second end remote from said one end thereof and disposed above said opening in said bucket, said second end bearing a control disk rotatable relative to said control shaft.

2. A coin dispenser as claimed in claim 1, wherein said thin disk is made of a synthetic resin.

3. A coin dispenser as claimed in claim 1, wherein said plurality of ribs are each integrally formed with a fin in order to direct air to the motor.

4. A coin dispenser as claimed in claim 3, each said fin being secured to said hub at the radially inner end of the associated said rib and having a lower edge that is outwardly upwardly inclined.

5. A coin dispenser as claimed in claim 1, and a pin upstanding from said flange a distance from said control shaft and terminating below said opening in said bucket.

* * * * *